US006809576B1

(12) United States Patent
Yamasaki

(10) Patent No.: US 6,809,576 B1
(45) Date of Patent: Oct. 26, 2004

(54) SEMICONDUCTOR INTEGRATED CIRCUIT DEVICE HAVING TWO TYPES OF INTERNAL POWER SUPPLY CIRCUITS

(75) Inventor: Kyoji Yamasaki, Hyogo (JP)

(73) Assignee: Renesas Technology Corp., Tokyo (JP)

( * ) Notice: Subject to any disclaimer, the term of this patent is extended or adjusted under 35 U.S.C. 154(b) by 767 days.

(21) Appl. No.: 09/124,962

(22) Filed: Jul. 30, 1998

(30) Foreign Application Priority Data

Jan. 23, 1998 (JP) ..... 10-011059

(51) Int. Cl.[7] ..... G05F 1/10
(52) U.S. Cl. ..... 327/540; 327/546
(58) Field of Search ..... 327/538, 540, 327/541, 543, 530, 73, 87

(56) References Cited

U.S. PATENT DOCUMENTS 5,821,808 A * 10/1998 Fujima ..... 327/540
5,861,771 A * 1/1999 Matsuda et al. ..... 327/540
5,886,565 A * 3/1999 Yasui et al. ..... 327/540
5,929,696 A * 7/1999 Lim et al. ..... 327/540

FOREIGN PATENT DOCUMENTS

JP 60-034050 2/1985
JP 07-141041 6/1995
JP 08-213907 8/1996

* cited by examiner

*Primary Examiner*—My-Trang Nu Ton
(74) *Attorney, Agent, or Firm*—McDermott Will & Emery LLP

(57) ABSTRACT

A resistance dividing circuit having the same voltage-dividing ratio as that of a voltage dividing circuit provided in a voltage-dividing voltage down-converting circuit divides a reference voltage employed in a direct feedback voltage down-converting circuit. The divided voltage is employed as the reference voltage for the voltage-dividing voltage down-converting circuit. A comparator cancels out temperature dependency of the resistance dividing circuit and the voltage dividing circuit by differential amplification, so that internal power supply voltages are identical in temperature dependency to each other. Thus, the internal power supply voltages generated by the direct feedback voltage down-converting circuit and the voltage-dividing voltage down-converting circuit have no difference in temperature dependency from each other.

10 Claims, 7 Drawing Sheets

SEMICONDUCTOR INTEGRATED CIRCUIT DEVICE HAVING TWO TYPES OF INTERNAL POWER SUPPLY CIRCUITS

BACKGROUND OF THE INVENTION

1. Field of the Invention

The present invention relates to a semiconductor integrated circuit device having internal power supply voltage down-converting circuits for down-converting an external power supply voltage and generating internal power supply voltages, and more particularly, it relates to a semiconductor integrated circuit device having at least one voltage-dividing type internal power supply voltage down-converting circuit and at least one direct feedback type internal power supply voltage down-converting circuit. More specifically, the present invention relates to a structure for equalizing internal power supply voltages generated by the voltage-dividing type and the direct feedback type internal power supply voltage down-converting circuits with each other in temperature dependency.

2. Description of the Prior Art

As a semiconductor integrated circuit device is improved in degree of integration, MOS transistors (insulated gate field-effect transistors) as the components thereof are refined in response. In order to guarantee a breakdown voltage of the refined transistors, operating power supply voltages must be reduced. However, an integrated circuit device such as a semiconductor memory device must be further refined as compared with an integrated circuit such as a processor or a logic circuit, in order to implement a large storage capacity. Further, it is necessary to keep compatibility with semiconductor memory devices of old generations. Therefore, the overall system power supply voltage cannot be reduced, and a high voltage of 3.3 V, for example, is employed as the system power supply voltage in consideration of compatibility with processors and logic circuits or devices of old generations, so that the integrated circuit device such as a semiconductor memory device down-converts this external power supply voltage to 2.5 V, for example, in its interior for generating the operating power supply voltages.

FIG. 11 illustrates an exemplary structure of a conventional internal power supply voltage down-converting circuitVDCa. Referring to FIG. 11, the internal power supply voltage down-converting circuit (hereinafter simply referred to as a voltage down-converting circuit) VDCa includes a comparator CMPa for comparing a voltage VIN1 on an internal power supply line VLa with a reference voltage Vref1 and outputting a signal indicating the result of the comparison, and a current drive transistor DRa formed by a p-channel MOS transistor and connected between a power supply node ENa receiving an external power supply voltage VEX and the internal power supply line VLa for supplying a current from the power supply node ENa to the internal power supply line VLa in accordance with the signal outputted from the comparator CMPa. The comparator CMPa receives the reference voltage Vref1 at its negative input, while receiving the internal power supply voltage VIN1 on the internal power supply line VLa at its positive input. The operation is now briefly described.

When the reference voltage Vref1 is higher than the internal power supply voltage VIN1, the output signal from the comparator CMPa goes low to increase the conductance of the current drive transistor Dra, for supplying the current from the power supply node ENa to the internal power supply line VLa and increasing the level of the internal power supply voltage VIN1. When the reference voltage Vref1 is lower than the internal power supply voltage VIN1, the output signal from the comparator CMPa goes high to bring the current drive transistor DRa into an OFF state, for cutting off the current path between the power supply node ENa and the internal power supply line VLa. Namely, when the internal power supply voltage VIN1 is lower than the reference voltage Vref1, the conductance of the current drive transistor DRa is adjusted in response to the voltage difference for supplying the current from the power supply node ENa to the internal power supply line VLa. Thus, the internal power supply voltage VIN1 is held substantially at the level of the reference voltage Vref1.

FIG. 12 illustrates another exemplary structure of a conventional voltage down-converting circuit VDCb. Referring to FIG. 12, the voltage down-converting circuit VDCb includes a resistive element RE connected between an internal power supply line VLb and a node ND, a constant current source IS connected between the node ND and a ground node supplying a ground voltage VSS which is a basic voltage, a comparator CMPb for comparing the voltage on the node ND with a reference voltage Vref2, and a current drive transistor DRb formed by a p-channel MOS transistor which is connected between a power supply node ENb receiving an external power supply voltage VEX and the internal power supply line VLb for supplying a current from the power supply node ENb to the internal power supply line VLb in accordance with an output signal of the comparator CMPb. The operation of the voltage down-converting circuit VDCb shown in FIG. 12 is now briefly described.

The comparator CMPb compares the voltage on the node ND with the reference voltage Vref2. Similarly to the voltage down-converting circuit VDCa shown in FIG. 11, the conductance of the current drive transistor DRb is adjusted in accordance with the output signal of the comparator CMPb, for substantially equalizing the voltage level on the node ND with the reference voltage Vref2. In this case, therefore, an internal power supply voltage VIN2 on the internal power supply line VLb is given by $V(ND)+I\cdot R$, where V(ND) represents the voltage on the node ND, and I and R represent the current supplied by the constant current source IS and the resistance value of the resistive element RE respectively. The internal power supply voltage VIN2 is reduced through the resistive element RE to be compared with the reference voltage Vref2, thereby driving the comparator CMPb in its most sensitive region and recovering the internal power supply voltage VIN2 to a prescribed level at a high speed upon its fluctuation.

It is possible to supply the internal power supply voltages VIN1 and VIN2 of a constant voltage level as operating power supply voltages for internal circuits by down-converting the external power supply voltage VEN through the voltage down-converting circuits VDCa and VDCb shown in FIGS. 11 and 12.

FIG. 13 schematically illustrates the overall structure of a conventional semiconductor integrated circuit device IC. Referring to FIG. 13, the semiconductor integrated circuit IC includes an internal circuit #A receiving the internal power supply voltage VIN1 from the voltage down-converting circuit VDCa shown in FIG. 11 as an operating power supply voltage, and an internal circuit #B receiving the internal power supply voltage VIN2 from the voltage down-converting circuit VDCb shown in FIG. 12 as an operating power supply voltage. No high-speed operation is required to the internal circuit #A, which in turn consumes a relatively large current. On the other hand, a high-speed operation is required to the internal circuit #B, which in turn consumes a relatively small current.

The semiconductor integrated circuit IC employs the voltage down-converting circuit VDCa which can supply a large current but is not required of high-speed response and the voltage down-converting circuit VDCb which is responsive to fluctuation of the internal power supply voltage VIN2 at a high speed while supplying a relatively small current, independently of each other depending on the operational characteristics of the internal circuits #A and #B respectively.

Particularly, when the internal circuit #A consumes a large current to fluctuate the internal power supply voltage VIN1, the semiconductor integrated circuit device IC can prevent the internal power supply voltage VIN2 for the internal circuit #B from an adverse influence by the fluctuation of the internal power supply voltage VIN1 (the voltage down-converting circuits VDCa and VDCb are provided independently of each other for the different internal power supply lines VLa and VLb, thereby preventing propagation of power supply noise). Thus, it is possible to implement a semiconductor integrated circuit device stably operating at a high speed.

The direct feedback voltage down-converting circuit VDCa directly comparing the internal power supply voltage VIN1 with the reference voltage Vref1 shown in FIG. 11 and the voltage-dividing voltage down-converting circuit VDCb shifting the level of the internal power supply voltage VIN2 for comparison with the reference voltage Vref2 are different in structure and temperature dependency from each other. The comparators CMPa and CMPb and the current drive transistors DRa and DRb exhibit substantially similar temperature dependency. If the temperatures of the current drive transistors Dra and DRb increase, for example, channel resistances thereof increase to reduce the levels of the internal power supply voltages VIN1 and VIN2. Even if the output signals from the comparators CMPa and CMPb are at low levels, the current drive transistors DRa and DRb enter OFF states due to change of threshold voltages thereof.

The difference in temperature dependency is small. However, the voltage-dividing voltage down-converting circuit VDCb includes the resistive element RE for level shifting and the constant current source IS, and hence the power supply voltages VIN1 and VIN2 generated by the direct feedback voltage down-converting circuit VDCa and the voltage-dividing voltage down-converting circuit VDCb remarkably differ in temperature dependency from each other.

For example, no particular problem arises when the difference ΔV between the internal power supply voltages VIN1 and VIN2 is small under a high temperature, as shown in FIG. 14A. If the resistive element RE is made of polysilicon and has an influence of its temperature dependency remarkable, the resistance value of the resistive element RE reduces to lower the level of the internal power supply voltage VIN2 under a low temperature. Therefore, the difference ΔV between the internal power supply voltages VIN1 and VIN2 increases as shown in FIG. 14B, to result in extremely different operationability of the internal circuits #A and #B utilizing these internal power supply voltages VIN1 and VIN2, and no desired performance can be attained. In the internal circuits #A and #B shown in FIG. 13, for example, the operating speed of the internal circuit #B reduces as compared with that of the internal circuit #A under a low temperature. Thus, the internal circuit #B cannot operate at a high speed, and desired performance of the semiconductor integrated circuit device IC cannot be implemented.

If the voltage difference ΔV increases in a boundary region between the internal circuits #A and #B, a malfunction may take place. It is noted that FIGS. 14A and 14B indicates that the internal power supply voltages VIN1 and VIN2 are set at the same voltage level of 2.5 V, as an example.

Consider a CMOS invertor which receives an input signal IN having the amplitude of the internal power supply voltage VIN2 and receives the internal power supply voltage VIN1 as an operating power supply voltage, as shown in FIG. 15. This CMOS invertor includes a p-channel MOS transistor PQ and an n-channel MOS transistor NQ. The internal signal IN is supplied to the gates of the MOS transistors PQ and NQ. Consider that the internal signal IN is at a high level equal to the level of the power supply voltage VIN2. If the difference ΔV between the internal power supply voltages VIN1 and VIN2 exceeds the absolute value of the threshold voltage of the p-channel MOS transistor PQ, the p-channel MOS transistor PQ is not turned off despite the high-level internal signal IN, and a through current is caused in this CMOS invertor to increase current consumption. When the voltage difference ΔV is large, an output signal OUT does not go low and a malfunction takes place in the internal circuit.

The difference of operational voltage dependency shown in FIGS. 14A and 14B is a mere example, and the difference ΔV between the internal power supply voltages VIN1 and VIN2 may reduce or increase under a low or high temperature, depending on the temperature dependency of the resistive element RE and the constant current source IS included in the voltage-dividing voltage down-converting circuit VDCb. If the constant current source IS is formed by a MOS transistor having a high temperature dependency, the current suppliability of the constant current source MOS transistor reduces to lower the internal power supply voltage VIN2 under a high temperature.

In case of employing the direct feedback voltage down-converting circuit VDCa and the voltage-dividing voltage down-converting circuit VDCb, the difference ΔV between the internal power supply voltages VIN1 and VIN2 increases in a certain temperature range due to the difference in temperature dependency therebetween, the internal circuits #A and #B remarkably differ in operational performance from each other, and therefore the performance of the semiconductor integrated circuit device IC disadvantageously reduces.

SUMMARY OF THE INVENTION

An object of the present invention is to provide a semiconductor integrated circuit device including voltage down-converting circuits having no difference in temperature dependency from each other.

Another object of the present invention is to provide a semiconductor integrated circuit device including internal voltage down-converting circuits, which stably operate in the overall temperature range.

Briefly stating, the semiconductor integrated circuit device according to the present invention utilizes a voltage employed by a direct feedback voltage down-converting circuit for generating an internal power supply voltage as a reference voltage or a comparand voltage for a voltage-dividing voltage down-converting circuit.

The semiconductor integrated circuit device according to the present invention includes a first comparator for comparing a first reference voltage with a voltage on a first internal power supply line and outputting a signal indicating the result of the comparison, a first current drive element coupled between a first power supply node receiving an external power supply voltage and the first internal power supply line for supplying a current from the first power supply node to the first internal power supply line in accordance with the signal outputted from the first comparator, a first voltage dividing circuit for dividing a voltage on a second internal power supply line by a prescribed ratio for outputting, a second voltage dividing circuit for dividing the first reference voltage by the prescribed ratio and generating a second reference voltage, a second comparator for comparing the second reference voltage with the voltage outputted from the first voltage dividing circuit and outputting a signal indicating the result of the comparison, and a second current drive element connected between a second power supply node receiving the external power supply voltage and the second internal power supply line for supplying a current from the second power supply node to the second internal power supply line in accordance with the signal outputted from the second comparator.

A reference voltage of a direct feedback voltage down-converting circuit is divided by the same ratio as that for dividing an internal power supply voltage of a voltage-dividing voltage down-converting circuit for generating a reference voltage, so that the voltage-dividing voltage down-converting circuit generates an internal power supply voltage on the basis of the divided reference voltage. Even if the temperature dependency of a voltage dividing circuit provided in the voltage-dividing voltage down-converting circuit remarkably varies, the reference voltage also varies responsively, whereby the internal power supply voltage generated by the direct feedback internal voltage down-converting circuit can be rendered substantially identical in temperature dependency to that generated by the voltage-dividing voltage down-converting circuit, and the internal power supply voltages can be stably supplied over the entire temperature range.

A second internal power supply voltage is generated with reference to the first internal power supply voltage, so that the second internal power supply voltage exhibits the same temperature dependency as that of the first internal power supply voltage employed as a reference voltage, whereby no difference is caused in temperature characteristics and the difference between the internal power supply voltages of the two voltage down-converting circuits is substantially constant over the entire temperature range.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[Embodiment 1]

Figure 1:
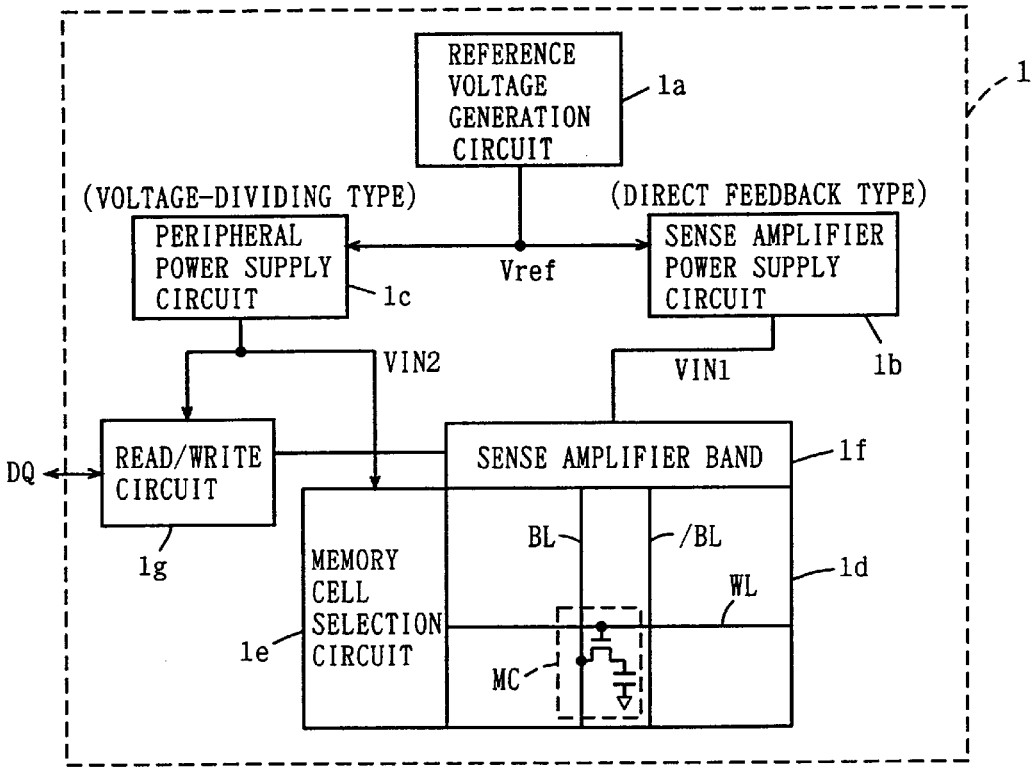
FIG. 1 schematically illustrates the overall structure of a semiconductor integrated circuit device according to an embodiment 1 of the present invention.

FIG. 1 schematically illustrates the overall structure of a semiconductor integrated circuit device 1 according to an embodiment 1 of the present invention. Referring to FIG. 1, the semiconductor integrated circuit device 1 includes a reference voltage generation circuit 1*a* for generating a reference voltage Vref, a direct feedback sense amplifier power supply circuit 1*b* for generating an internal power supply voltage VIN1 in accordance with the reference voltage Vref from the reference voltage generation circuit 1*a,* a voltage-dividing peripheral power supply circuit 1*c* for generating an internal power supply voltage VIN2 in accordance with the reference voltage Vref, a memory cell array 1*d* having memory cells MC arranged in rows and columns, a memory cell selection circuit 1*e* receiving the internal power supply voltage VIN2 from the peripheral power supply circuit 1*c* as an operating power supply voltage for selecting a memory cell MC of the memory cell array 1*d,* a sense amplifier band 1*f* receiving the internal power supply voltage VIN1 from the sense amplifier power supply circuit 1*b* as one operational power supplying voltage and sensing and amplifying memory cell data of the memory cell array 1*d,* and a read/write circuit 1*g* receiving the internal power supply voltage VIN2 from the peripheral power supply circuit 1*c* as an operating power supply voltage for reading/writing data from/in the selected memory cell MC through the sense amplifier band 1*f.*

The memory cell array 1*d* includes the memory cells MC arranged in rows and columns, a word line WL arranged in correspondence to each row of the memory cells MC, and a bit line pair BL and /BL arranged in correspondence to each column of the memory cells MC. FIG. 1 shows a single word line WL, a pair of bit lines BL and /BL, and a memory cell MC arranged in correspondence to the intersection between the word line WL and the bit line BL. The memory cell MC has a one-capacitor/one-transistor structure.

The memory cell selection circuit 1*e* includes a row selection circuit and a column selection circuit. The sense amplifier band 1*f* includes sense amplifiers provided in correspondence to the columns (bit line pairs,) of the memory cell array 1*d* respectively, for charging high-potential bit lines of the respective bit line pairs to the level of the internal power supply voltage VIN1 supplied from the sense amplifier power supply circuit 1*b.* The read/write circuit 1*g* includes an input buffer, an output buffer and an I/O gate.

In operation, the sense amplifier band 1*f* consumes a large current due to operation of the sense amplifiers provided in correspondence to the memory cell columns. However, each sense amplifier of the sense amplifier band 1*f* merely charges the bit line BL or /BL precharged at an intermediate voltage level to the power supply voltage VIN1 level, and the sense amplifier power supply circuit 1*b* is not required of high-speed response but must compensate for a large peak current flowing in the sensing operation. Therefore, the sense amplifier power supply circuit 1*b* is formed by a direct feedback voltage down-converting circuit causing no ringing when supplying a large current at a high speed.

On the other hand, the memory cell selection circuit 1*e* and the read/write circuit 1*g* must have high-speed operability, in order to input/output data at a high speed, Therefore, the peripheral power supply circuit 1*c* which is formed by a voltage-dividing voltage down-converting circuit with excellent high-speed response is employed as the power supply circuit for the peripheral circuits such as the memory cell selection circuit 1*e* and the read/write circuit 1*g*. The sense amplifier power supply circuit 1*b* and the peripheral power supply circuit 1*c* generate the internal power supply voltages VIN1 and VIN2 in accordance with the reference voltage Vref from the reference voltage generation circuit 1*a*. In the following description, it is assumed that the internal power supply voltages VIN1 and VIN2 are at the same level of 2.5 V, for example.

Figure 2:
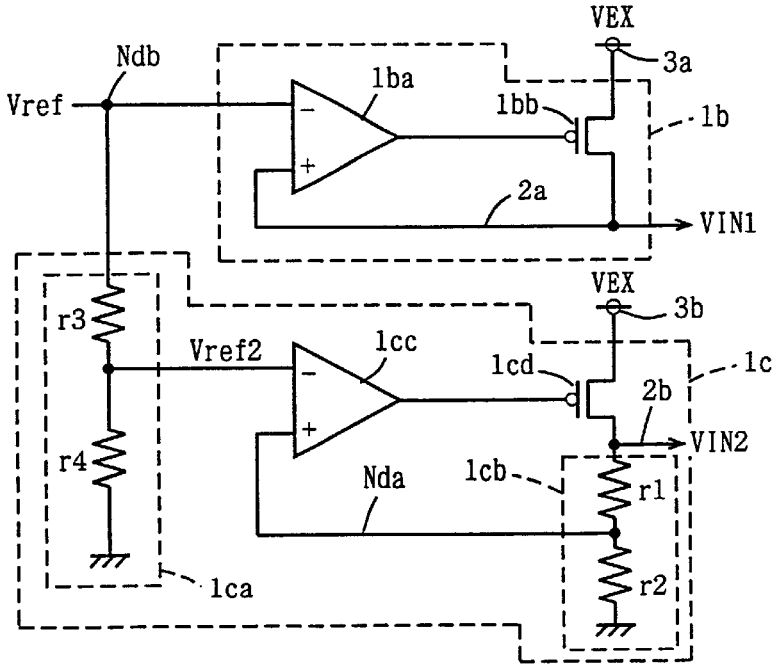
FIG. 2 illustrates the structures of a sense amplifier power supply circuit and a peripheral power supply circuit according to the embodiment 1 of the present invention.

FIG. 2 schematically illustrates the structures of the sense amplifier power supply circuit 1*b* and the peripheral power supply circuit 1*c* shown in FIG. 1. Referring to FIG. 2, the sense amplifier power supply circuit 1*b* includes a comparator 1*ba* for comparing the reference voltage Vref from the reference voltage generation circuit 1*a* with the internal power supply voltage VIN1 on an internal power supply line 2*a*, and a current drive transistor 1*bb* formed by a p-channel transistor which is connected between an external power supply node 3*a* and the internal power supply line 2*a* and receives an output signal from the comparator 1*ba* at its gate. This sense amplifier power supply circuit 1*b* generates the internal power supply voltage VIN1 of the reference voltage Vref level on the internal power supply line 2*a*.

The peripheral power supply circuit 1*c* includes a voltage dividing circuit 1*ca* for dividing the reference voltage Vref, a voltage dividing circuit 1*cb* for dividing the internal power supply voltage VIN2 on an internal power supply line 2*b* and outputting the divided voltage onto a node Nda, a comparator 1*cc* for comparing the voltage on the node Nda with a reference voltage Vref2 from the voltage dividing circuit 1*ca*, and a current drive transistor 1*cd* formed by a p-channel MOS transistor which is connected between an external power supply node 3*b* and the internal power supply line 2*b* and receives an output signal from the comparator 1*cc* at its gate.

The voltage dividing circuit 1*ca* includes resistive elements r3 and r4 serially connected between a node Ndb and a ground node supplying a ground voltage which is a base voltage. The reference voltage Vref2 is outputted from a node between the resistive elements r3 and r4. Therefore, the reference voltage Vref2 is expressed as follows:

$$Vref2=r4\cdot Vref/(r3+r4)$$

The voltage dividing circuit 1*cb* includes resistive elements r1 and r2 serially connected with each other between the internal power supply line 2*b* and a ground node. A node between the resistive elements r1 and r2 is connected to the node Nda. In this case, therefore, the voltage V(Nda) on the node Nda is expressed as follows:

$$V(Nda)=VIN2\cdot r2/(r1+r2)$$

The resistive elements r1 to r4 are made of the same material to have the same temperature characteristics, and the resistance values thereof are set to satisfy the following condition:

$$r1:r2=r3:r4=1:x$$

The voltage V(Nda) on the node Nda is equal to the reference voltage Vref2. Therefore, the following expression is obtained:

$$VIN2\cdot r2/(r1+r2)=r4\cdot Vref/(r3+r4)$$

Hence, $$VIN2=Vref$$

Namely, the voltage VIN2 on the internal power supply line 2*b* is equal to the reference voltage Vref, and hence equal to the internal power supply voltage VIN1. The voltage-dividing ratios of the voltage dividing circuits 1*cb* and 1*ca* are equalized with each other, so that the internal power supply voltage VIN2 on the internal power supply line 2*b* is held at the level of the constant voltage Vref with no influence by the temperature characteristic of the voltage dividing circuit 1*cb* and the internal power supply voltages VIN1 and VIN2 can be equalized with each other in response. This can be qualitatively described as follows:

When the characteristics of the voltage dividing circuit 1*cb* change following temperature change to change the voltage level of the node Nda, the reference voltage Vref2 also changes in the voltage dividing circuit 1*ca* due to the same temperature characteristic, and the differentially amplifying comparator 1*cc* cancels out the change of the temperature characteristics of the voltage dividing circuits 1*cb* and 1*ca*. When the characteristics of the voltage dividing circuit 1*cb* change following temperature change to increase the voltage level of the node Nda, for example, similar characteristic change takes place in the voltage dividing circuit 1*ca* to increase the voltage level of the reference voltage Vref2, and the comparator 1*cc* cancels out the voltage increases by differential amplification.

Thus, it is possible to compensate for change of the characteristics of the voltage dividing circuits 1*ca* and 1*cb* for down-converting the internal power supply voltages VIN1 and VIN2 by generating the reference voltages Vref1 and Vref2 from the voltage dividing circuits 1*ca* and 1*cb* formed of the same material and having the same voltage-dividing ratio, to hold the internal power supply voltages VIN1 and VIN2 at the same voltage level with no influence from temperature change.

[Modification]

Figure 3:
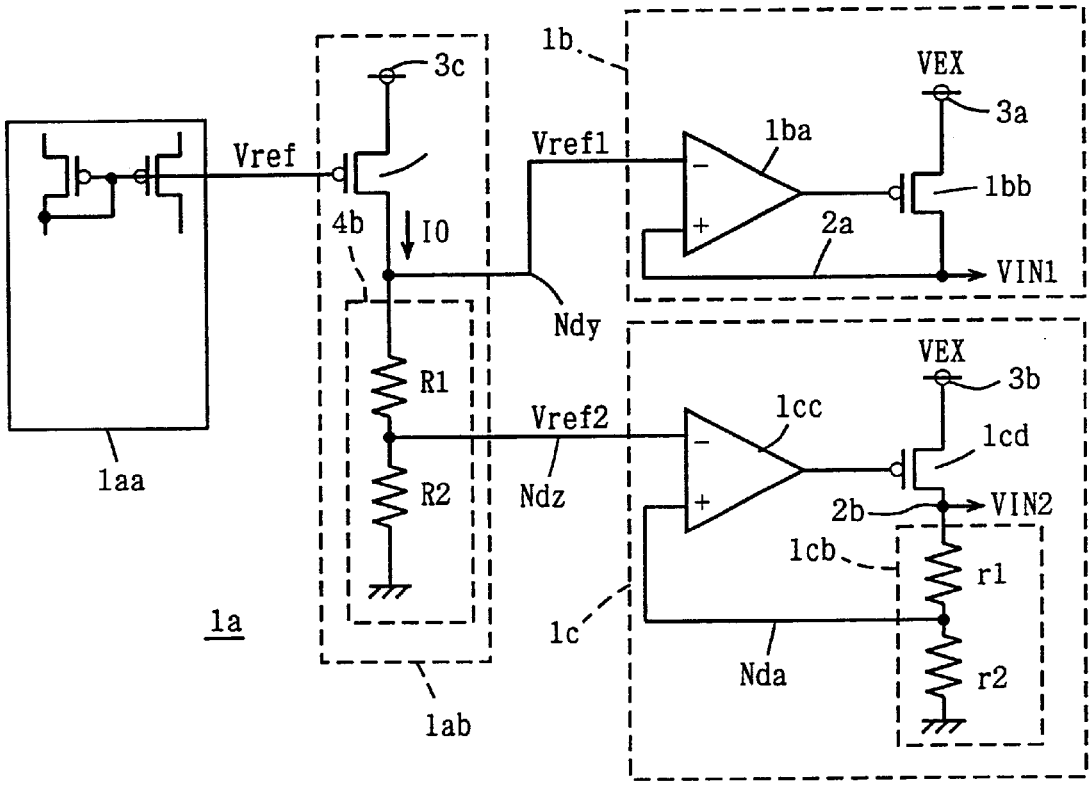
FIG. 3 illustrates the structure of a modification of the semiconductor integrated circuit device according to the embodiment 1 of the present invention.

FIG. 3 illustrates the structure of a modification of the semiconductor integrated circuit device 1 according to the embodiment 1 of the present invention. FIG. 3 shows the structures of a sense amplifier power supply circuit 1*b*, a peripheral power supply circuit 1*c* and a reference voltage generation circuit 1*a*. Referring to FIG. 3, the reference voltage generation circuit 1*a* includes a constant current circuit 1*aa* including a current-mirror circuit, for example, for generating a reference voltage Vref through constant current generation, and a reference voltage generation circuit 1*ab* for generating reference voltages Vref1 and Vref2 for the sense amplifier power supply circuit 1*b* and the peripheral power supply circuit 1*c* respectively in accordance with the transformed reference voltage Vref from the constant current circuit 1*aa*.

The reference voltage generation circuit 1*ab* includes a constant current source transistor 4*a* formed by a p-channel MOS transistor operating as a slave stage of the current-mirror circuit included in the constant current circuit 1*aa* for generating a constant current I0 in accordance with the reference voltage Vref, and a resistance voltage-dividing circuit 4*b* for generating the reference voltages Vref1 and Vref2 in accordance with the current I0 supplied by the constant current source transistor 4*a*. The resistance voltage-dividing circuit 4*b* includes resistive elements R1 and R2 serially connected between a node Ndy and a ground node. The reference voltages Vref1 and Vref2 are outputted from the node Ndy between the constant current source transistor 4*a* and the resistance voltage-dividing circuit 4*b* and a node Ndz between the resistive elements R1 and R2 respectively.

The sense amplifier power supply circuit 1*b* includes a comparator 1*ba* and a current drive transistor 1*bb* for supplying a current to an internal power supply line 2*a* in accordance with an output signal from the comparator 1*ba,* similarly to the structure shown in FIG. 2. The peripheral power supply circuit 1*c* includes a voltage dividing circuit 1*cb* for dividing an internal power supply voltage VIN2 by resistance division and transmitting the divided voltage to a node Nda, a comparator 1*cc* for comparing the voltage of the node Nda with the reference voltage Vref2, and a current drive transistor 1*cd* for supplying a current from an external power supply node 3*b* to an internal power supply line 2*b* in accordance with an output signal of the comparator 1*cc*.

The ratio of the resistance values of the resistive elements R1 and R2 included in the resistance voltage-dividing circuit 4*b* is equalized with that of the resistance values of resistive elements r1 and r2 included in the voltage dividing circuit 1*cb*. Namely, R1/R2=r1/r2. The resistive elements R1, R2, r1 and r2 are made of the same material. Therefore, the voltage dividing circuit 1*cb* and the resistance voltage-dividing circuit 4*b* have the same temperature characteristics.

In the structure shown in FIG. 3, the current source transistor 4*a* operates as the slave stage of the current-mirror circuit included in the constant current circuit 1*aa* and supplies the constant current I0 corresponding to the constant current supplied by the constant current circuit 1*aa*. Therefore, the reference voltage Vref1 is expressed as follows:

$$V\text{ref}1=I0\cdot(R1+R2)$$

The reference voltage Vref2 is expressed as follows:

$$V\text{ref}2=I0\cdot R2=R2\cdot V\text{ref}1/(R1+R2)$$

Further, the voltage dividing circuit 1*cb* equalizes the voltage of the node Nda with the reference voltage Vref2 by voltage division, whereby the following expression is obtained:

$$V(Nda)=V\text{ref}2=r2\cdot V\text{IN}2/(r1+r2)$$

The ratio of the resistance values of the resistive elements R1 and R2 is equal to that of the resistance values of the resistive elements r1 and r2, whereby the following expression is obtained:

$$V\text{IN}2=V\text{ref}1=V\text{IN}1$$

Also in the structure shown in FIG. 3, therefore, the internal power supply voltages VIN1 and VIN2 are equalized with each other through the reference voltage Vref1, with no influence by the temperature characteristic of the voltage dividing circuit 1*cb*. Thus, the internal power supply voltages VIN1 and VIN2 can be set at the same level over the entire temperature range.

In the structure shown in FIG. 3, further, the sense amplifier power supply circuit 1*b* and the peripheral power supply circuit 1*c* share the resistance circuit 4*b* for generating the reference voltages Vref1 and Vref2. Therefore, the circuit occupying area can be reduced as compared with a structure including circuits for generating the reference voltages Vref1 and Vref2 by current-to-voltage transformation independently of each other. Further, the reference voltage Vref2 can be generated at a prescribed voltage-dividing ratio without exerting an adverse influence on the reference voltage Vref1.

According to the embodiment 1 of the present invention, as hereinabove described, the voltage dividing circuit having the same voltage dividing ratio as that of the voltage dividing circuit of the voltage-dividing voltage down-converting circuit is employed for dividing the reference voltage for the direct feedback voltage down-converting circuit and generating the reference voltage for the voltage-dividing voltage down-converting circuit. Therefore, influence by the temperature characteristic of the voltage dividing circuit of the voltage-dividing voltage down-converting circuit can be canceled out by differential amplification of the comparator, the difference between the internal power supply voltages generated by the direct feedback voltage down-converting circuit and the voltage-dividing voltage down-converting circuit can be held constant over the entire temperature range, and a stable circuit operation can be guaranteed.

The resistive elements r1 and r2 of the voltage dividing circuit 1*cb* and the resistive elements r3 and r4 or R1 and R2 of the voltage dividing circuit 1*ca* or the resistance dividing circuit 4*b* for generating the reference voltage Vref2 are made of the same material, in order to equalize the temperature characteristics with each other. The resistive elements r1 and r2 and r3 and r4 or R1 and R2 may be formed by resistance-connected MOS transistors. In case of such resistance-connected MOS transistors, however, the gate-to-source voltages vary from a resistive element to a resistance element and some expedient is required for correctly setting the resistance values. Therefore, polysilicon resistances may be employed, or ion-implanted polysilicon may be employed for readily implementing resistive elements having desired resistance values by implanting ions into polysilicon resistances and adjusting the resistance values thereof.

[Embodiment 2]

Figure 4:
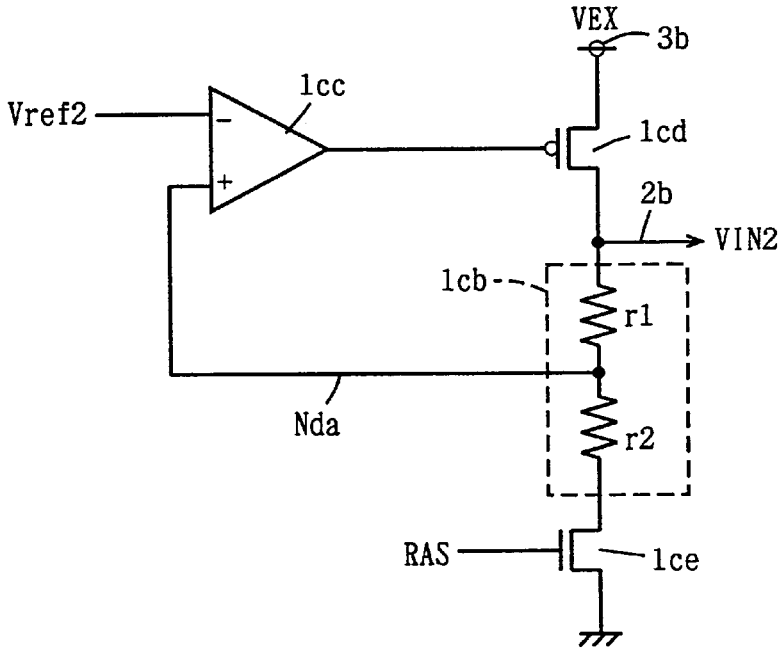
FIG. 4 illustrates the structure of a main part of a semiconductor integrated circuit device according to an embodiment 2 of the present invention.

FIG. 4 illustrates the structure of a main part of a semiconductor integrated circuit device according to an embodiment 2 of the present invention. FIG. 2 shows only the structure of a peripheral power supply circuit 1*c*. The remaining structure is similar to that of the semiconductor integrated circuit device according to the embodiment 1. Referring to FIG. 4, the peripheral power supply circuit 1*c* includes an n-channel MOS transistor 1*ce* connected between a voltage dividing circuit 1*cb* and a circuit 1*cb* and a ground node and receiving an internal row address strobe signal RAS at its gate. The remaining structure is identical to that of the peripheral power supply circuit 1*c* shown in FIG. 2 or 3.

In the structure shown in FIG. 4, the internal row address strobe signal RAS enters an inactive state of a low level in a standby cycle, for bringing the MOS transistor 1*ce* into a non-conducting state and cutting off the path of a current flowing from an internal power supply line 2*b* to the ground node.

When the internal row address strobe signal RAS enters an active state of a high level, an active cycle is started for selecting a memory cell. The peripheral power supply circuit 1*c* must operate in this cycle, and the MOS transistor $\mathbf{1}_{ce}$ conducts to form the path for the current between the internal power supply line 2*b* and the ground node and activates the peripheral power supply circuit 1*c* for generating an internal power supply voltage VIN2. Thus, the current consumed by the peripheral power supply circuit 1*c* can be reduced in the standby cycle, to implement a semiconductor integrated circuit device of low power consumption. The voltage dividing circuit 1*cb* merely shifts down the internal power supply voltage VIN2 and is not required of high current drivability, and resistive elements r1 and r2 are set at a resistance value for allowing a current flow of a microampere order, in order to prevent unnecessary consumption of a current from the internal power supply line 2*b*. A current of the same degree flows also in a reference voltage generation circuit 1*a*.

[Modification]

Figure 5:
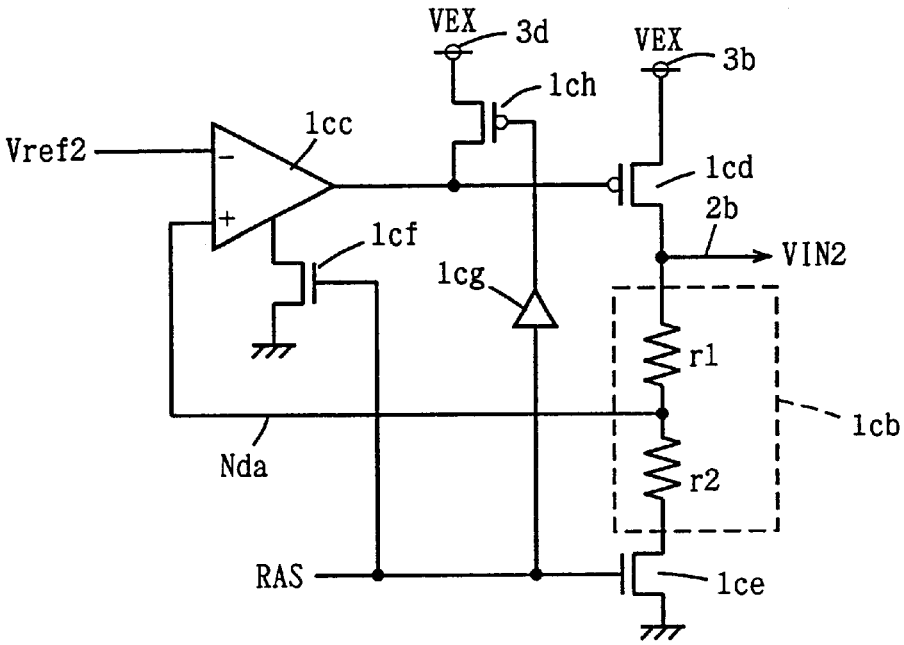
FIG. 5 illustrates the structure of a modification of the semiconductor integrated circuit device according to the embodiment 2 of the present invention.

FIG. 5 illustrates the structure of a modification of the semiconductor integrated circuit device according to the embodiment 2 of the present invention. FIG. 5 shows the structure of a peripheral power supply circuit 1*c*. The peripheral power supply circuit 1*c* shown in FIG. 5 further includes a current source transistor 1*cf* for activating a comparison operation of a comparator 1*cc* in response to activation of an internal row address strobe signal RAS, a level convertor 1*cg* for converting the voltage level of the internal row address strobe signal RAS, and a p-channel MOS transistor 1*ch* connected between an external power supply node 3*d* and the gate of a current drive transistor 1*cd* and receiving an output signal from the level convertor 1*cg* at its gate, in addition to the structure shown in FIG. 4. The level convertor 1*cg* receives an external power supply voltage VEX as an operating power supply voltage, and converts a high level of the internal row address strobe signal RAS to the level of the external power supply voltage VEX. The remaining structure is identical to that shown in FIG. 4, and corresponding parts are denoted by the same reference numerals.

In the structure shown in FIG. 5, voltage division of a voltage dividing circuit 1*cb* is stopped when the internal row address strobe signal RAS is inactive in a standby state (this is identical to the structure shown in FIG. 4). In this case, the voltage of node Nda is at the level of internal power supply voltage VIN2, which is higher than a reference voltage Vref2. In this state, therefore, the comparator 1*cc* outputs a high-level signal, and the current drive transistor 1*cd* enters an OFF state. At this time, the current source transistor 1*cf* is made non-conductive to stop the comparison operation of the comparator 1*cc* for suppressing current consumption therein. At this time, the level convertor 1*cg* outputs a low-level signal, the p-channel MOS transistor 1*ch* conducts and the gate voltage of the current drive transistor 1*cd* reaches the level of the external power supply voltage VEX to reliably set the current drive transistor 1*cd* in a non-conducting state. In the standby cycle, therefore, current consumption in the peripheral power supply circuit 1*c* is reliably prevented for further reducing current consumption.

When an active cycle is started, the internal row address strobe signal RAS goes high and the MOS transistors 1*cf* and 1*ce* conduct to enable the comparator 1*cc* and the voltage dividing circuit 1*cb* respectively. On the other hand, the output signal of the level convertor 1*cg* reaches the level of the external power supply voltage VEX, to reliably set the p-channel MOS transistor 1*ch* in a non-conducting state.

Figure 6:
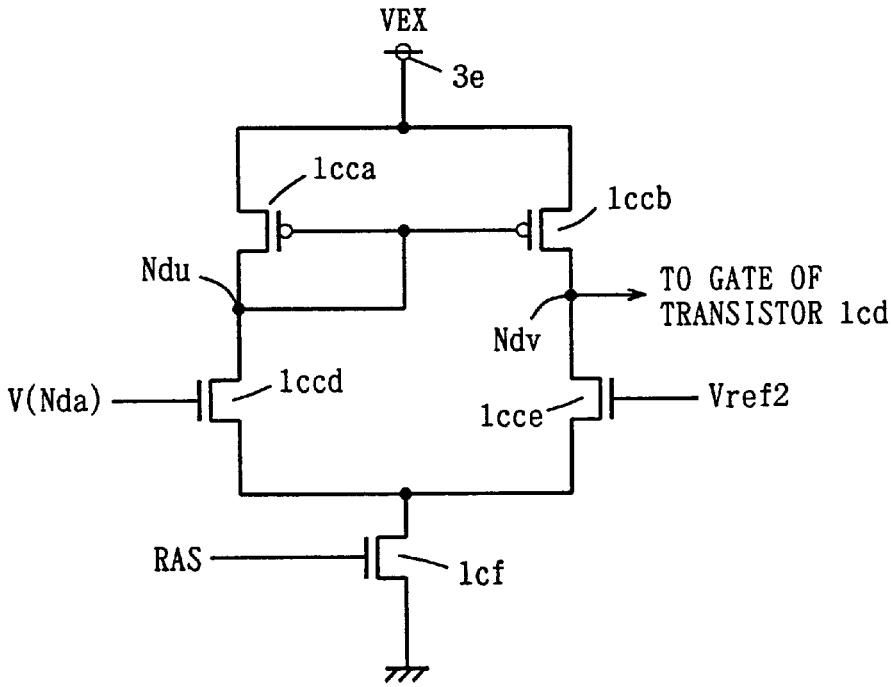
FIG. 6 illustrates an exemplary structure of a compare circuit shown in FIG. 5.

FIG. 6 illustrates an exemplary structure of the comparator 1*cc* shown in FIG. 5. Referring to FIG. 6, the comparator 1*cc* includes a p-channel MOS transistor 1*cca* connected between an external power supply node 3*e* and a node Ndu and having its gate connected to the node Ndu, a p-channel MOS transistor 1*ccb* connected between the external power supply node 3*e* and a node Ndv and having its gate connected to the node Ndv, an n-channel MOS transistor 1*ccd* connected between the node Ndu and the MOS transistor 1*cf* and receiving a voltage V(Nda) on the node Nda at its gate, and an n-channel MOS transistor 1*cce* connected between the node Ndv and the MOS transistor 1*cf* and receiving the reference voltage Vref2 at its gate. The node Ndv is connected to the gate of the current drive transistor 1*cd*. The operation of the comparator 1*cc* shown in FIG. 6 is now briefly described.

When the internal row address strobe signal RAS is at a low level in the standby cycle, the MOS transistor 1*cf* is in a non-conducting state for cutting off a current path from the external power supply node 3*e* to a ground node. In this case, therefore, the node Ndv reaches a voltage level close to the external power supply voltage VEX (a voltage level lower by the absolute value of the threshold voltage of the MOS transistor 1*ccb*). In this state, the MOS transistor 1*ccb* enters an OFF state, and the node Ndv enters a floating state due to the OFF state of the MOS transistor 1*cf*. The MOS transistor 1*ch* shown in FIG. 5 conducts in this state, to hold the node Ndv at the level of the external power supply voltage VEX.

When the active cycle is started, the internal row address strobe signal RAS goes high, and the MOS transistor 1*cf* conducts to form the current path from the external power supply node 3*e* to the ground node, for allowing comparison of the comparator 1*cc*. The comparator 1*cc* shown in FIG. 6 has the structure of a differential amplifier circuit, and the conductance of the MOS transistor 1*cce* exceeds that of the MOS transistor 1*ccd* if the reference voltage Vref2 is higher than the voltage V(Nda). The MOS transistor 1*ccd* is supplied with a current from the MOS transistor 1*cca*. The MOS transistors 1*cca* and 1*ccb* form a current mirror circuit, and the MOS transistor 1*cca* serves as a master stage of this current mirror circuit. Thus, a current of the same magnitude as that flowing through the MOS transistors 1*cca* and 1*ccd* flows through the MOS transistors 1*ccb* and 1*cce*. MOS transistor 1*cce* discharges the supplied current, to reduce the voltage level of the node Ndv. Thus, the conductance of the current drive transistor 1*cd* is increased to increase the level of the internal power supply voltage VIN2.

When the voltage V(Nda) is higher than the reference voltage Vref2, the conductance of the MOS transistor 1*ccd* exceeds that of the MOS transistor 1*cce,* and the current flowing through the MOS transistor 1*ccd* exceeds that flowing through the MOS transistor 1*cce*. Therefore, the MOS transistor 1*cce* cannot discharge all current supplied through the MOS transistor 1*ccb,* the level of the node Ndv is increased to increase the gate voltage of the current drive transistor 1*cd,* and current supply operation to an internal power supply line is stopped.

When the MOS transistor 1*cf* is normally set in a conducting state in the comparator 1*cc* as shown in FIG. 6, the currents regularly flow through the MOS transistors 1*ccd* and 1*cce*. This comparator 1*cc* performs differential amplification required of high-speed response in particular, and hence consumes a relatively large quantity of current. Therefore, current consumption of the comparator 1*cc* can be stopped by bringing the MOS transistor 1*cf* into a non-conducting state in the standby cycle requiring low current consumption, thereby implementing low current consumption.

According to the embodiment 2 of the present invention, as hereinabove described, the voltage dividing operation of the peripheral power supply circuit for peripheral circuits and/or the operation for comparing the internal power supply voltage with the reference voltage is stopped in the standby cycle, whereby current consumption can be remarkably reduced in the standby cycle.

[Embodiment 3]

Figure 7:
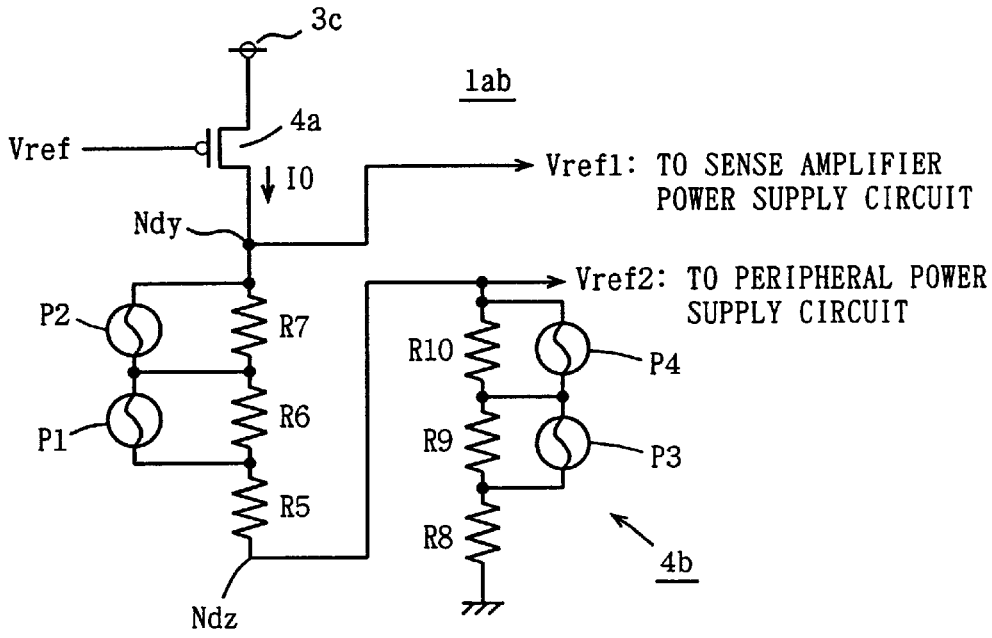
FIG. 7 illustrates the structure of a main part of a semiconductor integrated circuit device according to an embodiment 3 of the present invention.

FIG. 7 illustrates the structure of a main part of a semiconductor integrated circuit device according to an embodiment 3 of the present invention. FIG. 7 shows the structure of a part corresponding to the reference voltage generation circuit 1*ab* shown in FIG. 3. Referring to FIG. 7, this reference voltage generation circuit 1*ab* includes a current source transistor 4*a* formed by a p-channel MOS transistor which is connected between an external power supply node 3*c* and a node Ndy and receives a reference voltage Vref at its gate, and a resistance voltage-dividing circuit 4*b* connected between the node Ndy and a ground node for generating reference voltages Vref1 and Vref2. This resistance voltage-dividing circuit 4*b* includes resistive elements R7, R6 and R5 serially connected between the node Ndy and a node Ndz, resistive elements R10, R9 and R8 serially connected between the node Ndz and the ground node, and fusible low-resistance link elements P1, P2, P3 and P4 connected in parallel with the resistive elements R6, R7, R9 and R10 respectively. The resistive elements R5 to R10 are made of the same material as that for resistive elements r1 and r2. The reference voltage Vref2 for a peripheral power supply circuit is outputted from the node Ndz.

The resistive elements R5 to R7 are provided in correspondence to the resistive elements R8 to R10 respectively. The resistance values of the resistive elements R5 to R7 serially connected between the nodes Ndy and Ndz and the resistive elements R8 to R10 connected between the node Ndz and the ground node satisfy the following relation:

$$R7/R10=R6/R9=R5/R8=r1/r2$$

Link elements of the link elements P1 to P4 connected to a resistive element of the resistive elements R5 to R7 and a corresponding one of the resistive elements R8 to R10 are blown off. Namely, the link elements P1 and P3 are fused out in a pair, and the link elements P2 and P4 are fused out in a pair. The operation of the reference voltage generation circuit 1*ab* shown in FIG. 7 is now described.

A final step for the semiconductor integrated circuit device includes a step of testing whether or not the reference voltages Vref1 and Vref2 are set at prescribed levels respectively. The reference voltage Vref, which is generated by current-to-voltage transformation of a constant current circuit, is not particularly adjusted in this step. Namely, a current I0 flowing through the current source transistor 4*a* remains constant. The reference voltage Vref1 reaches the highest level when all resistive elements R5 to R10 are connected. In this state, the reference voltage Vref1 is expressed as follows:

$$Vref1=I0\cdot(R5+R6+R7+R8+R9+R10)$$

On the other hand, the reference voltage Vref1 reaches the lowest level when only the resistive elements R5 and R8 are employed. In this case, the reference voltage Vref1 is expressed as follows:

$$Vref1=I0\cdot(R5+R8)$$

Therefore, the level of the reference voltage Vref1 can be adjusted by selectively fusing out the link elements P1 to P4 and adjusting the resistance values between the node Ndy and the ground node. In this trimming step, link elements of the link elements P1 to P4 provided for the paired ones of the resistive elements R5 to R7 and R8 to R10 are fused out. For example, the link elements P2 and P4 are fused out. At this time, the resistive elements R7, R5, R10 and R8 are connected between the node Ndy and the ground node. The reference voltage Vref2 is generated by resistance-dividing the reference voltage Vref1. Link elements of the link elements P1 to P4 provided for the corresponding ones among the resistive elements R5 to R7 and R8 to R10 are fused out. In this case, therefore, the ratio of the resistance between the nodes Ndy and Ndz to that between the node Ndz and the ground node remains constant regardless of fusion/non-fusion of the link elements P1 to P4. Namely, $$R5/R8=(R5+R6)/(R8+R9)=(R5+R6+R7)/(R8+R9+R10)=r1/r2$$

This relation can be readily obtained from the following relational expressions with k being a positive real number:

$$R5=k\cdot R8$$

$$R6=k\cdot R9$$

$$R7=k\cdot R10$$

When the link elements P1 to P4 are fused out in pairs for trimming the reference voltage Vref1 in order to adjust the voltage level of a sense amplifier power supply circuit, therefore, the level of the reference voltage Vref2 is also adjusted at the same time. Thus, the reference voltages Vref1 and Vref2 need not be adjusted independently of each other for the sense amplifier power supply circuit and the peripheral power supply circuit, and the trimming step for adjusting internal power supply voltage levels is remarkably simplified.

According to the embodiment 3 of the present invention, as hereinabove described, the resistive elements having the same resistance ratio as that of the voltage dividing circuit of the voltage-dividing voltage down-converting circuit are serially connected with each other for forming the reference voltage dividing circuit and the link elements are connected in parallel with the resistive elements. The link elements provided for the paired ones of the resistive elements are fused out, whereby the second reference voltage can also be trimmed in the trimming processing for the first reference voltage, and the trimming step is simplified. In particular, a fuse blow step for fusing out the link elements is simplified.

[Embodiment 4]

Figure 8:
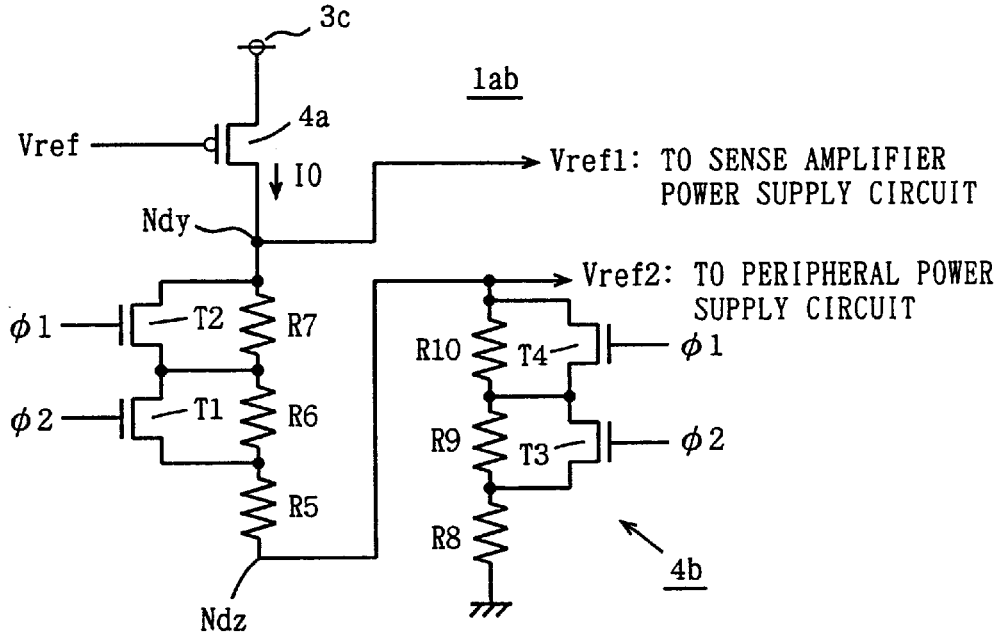
FIG. 8 illustrates the structure of a main part of a semiconductor integrated circuit device according to an embodiment 4 of the present invention.

FIG. 8 illustrates the structure of a main part of a semiconductor memory device according to an embodiment 4 of the present invention. FIG. 8 shows the structure of a reference voltage generation circuit 1*ab* for generating reference voltages Vref1 and Vref2, similarly to FIG. 7. The reference voltage generation circuit 1*ab* shown in FIG. 8 includes MOS transistors T1 to T4 which conduct in response to test signals $\phi1$ and $\phi2$, provided for a prescribed number of resistive elements R6, R7, R9 and R10 among resistive elements R5 to R10 connected between a node Ndy and a ground node. Similarly to the embodiment 3, the resistance values of the resistive elements R5 to R10 satisfy the following relation:

$$R5/R8=R6/R9=R7/R10=r1/r2$$

The resistance values of the MOS transistors T1 to T4 in conduction thereof are set at extremely small values negligible as compared with those of the resistive elements R5 to R10. The reference voltages Vref1 and Vref2 are supplied to a sense amplifier power supply circuit and a peripheral power supply circuit respectively. Therefore, high-level data at the level of an internal power supply voltage generated in accordance with the reference voltage Vref1 is written in a memory cell. If the reference voltage Vref1 is at a lowered level, the voltage level of the high-level data written in the memory cell is reduced in response. If the reference voltage Vref1 is lower than a prescribed value, a normal memory cell may be determined as defective in testing charge retentionability of the memory cell or the like.

If the reference voltage Vref2 is at a lowered level in case of generating a substrate bias voltage with an internal power supply voltage generated in accordance with the reference voltage Vref2 supplied to the peripheral power supply circuit, the frequency of an oscillator included in a substrate bias voltage generation circuit is so reduced that the substrate bias voltage cannot be generated with sufficient charge suppliability and is shallowed (the absolute value is reduced). In this case, a leakage current from the memory cell to the substrate is reduced. If the substrate bias voltage is deepened (the reference voltage Vref2 is increased), on the other hand, the leakage current from the memory cell to the substrate is increased. In case of determining pass/failure of a memory cell, therefore, such test must be made after trimming the reference voltages Vref1 and Vref2.

If the reference voltages Vref1 and Vref2 are trimmed using link elements in this case, fuses must be blown off for programming a defective address in a program processing for replacing a defective memory cell after determining pass/failure of the memory cell. Therefore, a fuse blow step is added. In order to prevent this, the reference voltages Vref1 and Vref2 are measured by bringing MOS transistors provided in correspondence to the fuses to be blown off into non-conducting states on the basis of the reference data. A pass/fail test for the memory cells is made in this state.

Thereafter fuse elements (see FIG. 7) provided in correspondence to the respective resistive elements are fused out in programming of a defective memory cell address, i.e., in programming for replacing a redundant cell. Thus, a link element fusing in a trimming step can be performed only once simultaneously with the fuse programming for the defective cell repairing.

In the structure shown in FIG. 8, the MOS transistors T1 to T4 are employed in place of the link elements P1 to P4 shown in FIG. 7 and selectively brought into conducting/non-conducting states in accordance with the test signals ϕ1 and ϕ2 to simulatively implement a state identical to link blow off by laser trimming, and a test such as determination of pass/failure of a memory cell is made in a following step. Also in this case, conduction/non-conduction of those of the MOS transistors T1 to T4 which are provided for those arranged in correspondence to each other among the resistive elements R6, R7, R9 and R10 is controlled. Thus, the reference voltage Vref2 can be trimmed with only data for the reference voltage Vref1.

Figure 9:
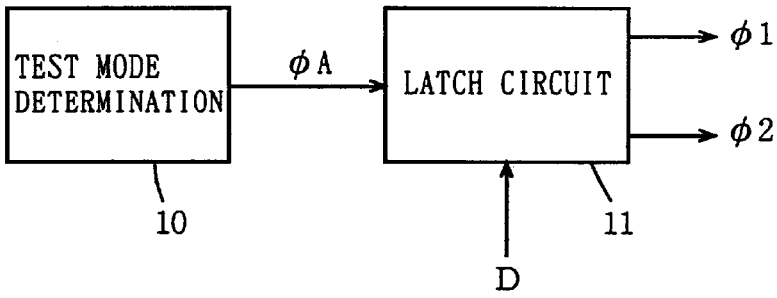
FIG. 9 illustrates the structure of a test signal generation part shown in FIG. 8.

FIG. 9 schematically illustrates the structure of a test signal generation part. Referring to FIG. 9, the test signal generation part includes a test mode determination circuit 10 for determining whether or not a test mode of operation instructing trimming of the reference voltages Vref1 and Vref2 is specified, and a latch circuit 11 for taking in and latching data D indicating conduction/non-conduction of the MOS transistors T1 to T4 provided in correspondence to the fusible link elements in response to a test mode detection signal ϕA from the test mode determination circuit 10 and generating the test signals ϕ1 and ϕ2 in accordance with the latched data D.

The test mode determination circuit 10 determines a test mode signal in accordance with a well-known timing condition such as "WCBR+address key" condition, for determining whether or not simulative trimming of the reference voltages Vref1 and Vref2 is specified. When a simulative trimming step for the reference voltages Vref1 and Vref2 is specified (the control signal ϕA is activated), the latch circuit 11 takes in and latches the externally supplied data D indicating conduction/non-conduction of the MOS transistors T1 to T4 provided in correspondence to the fusible link elements, for generating the test signals ϕ1 and ϕ2.

Namely, the reference voltage Vref1 is first measured through a specific pad, for example, to determine whether or not the reference voltage Vref1 is at a prescribed level. If the level of the reference voltage Vref1 is different from the prescribed level, a determination is made as to which of the MOS transistors T1 to T4 is or are brought into conducting (or non-conducting) states, in order to set the reference voltage Vref1 at the prescribed level. Following this determination, a test mode specifying signal for trimming is first supplied to the test mode determination circuit 10. When supplied with instruction of the simulative trimming step, the test mode determination circuit 10 activates the test mode detection signal ϕA. The latch circuit 11 receives and latches the data D indicating those of the MOS transistors T1 to T4 to be brought into conducting (or non-conducting) states, and generates the test signals ϕ1 and ϕ2. The reference voltage Vref1 is measured again in this state, for determining whether or not the same is at the desired level. If the level of the reference voltage Vref1 is different from the desired level, conduction/non-conduction of the MOS transistors T1 to T4 is determined again, to enter the test mode again through the test mode determination circuit 10 and set the test signal in the latch circuit 11. This operation is repeated until the reference voltage Vref1 reaches the desired level.

In this case, the paired transistors T2 and T4 as well as T1 and T3 are simultaneously set in the same states respectively. Therefore, the reference voltage Vref2 is also simulatively trimmed simultaneously with trimming of the reference voltage Vref1, and the number of steps for controlling conduction/non-conduction of the MOS transistors T1 to T4 is remarkably reduced.

The structures shown in FIGS. 7 and 8 may be combined with each other. In this case, the MOS transistors T1 to T4 are serially connected with the link elements P1 to P4.

In the structure shown in FIG. 8, three or more transistors may be connected between the node Ndy and the ground node. The number of the transistors can be arbitrarily selected so far as the ratio of the resistance values of the paired transistors arranged in the voltage dividing circuit is identical to the resistance ratio of voltage dividing resistive elements of the voltage dividing circuit of a voltage-dividing voltage down-converting circuit and the corresponding resistive elements are simultaneously shorted or non-shorted and made of the same material.

According to the embodiment 4 of the present invention, as hereinabove described, switching transistors conducting in response to the test signal are provided in parallel with a prescribed number of resistive elements in a resistance dividing circuit for generating a reference voltage and the switching transistors provided in correspondence to the resistive elements arranged in correspondence to each other are set in conducting or non-conducting states, whereby the second reference voltage can be simulatively trimmed in trimming of the first reference voltage and the process of reference voltage adjustment is remarkably simplified.

[Embodiment 5]

Figure 10:
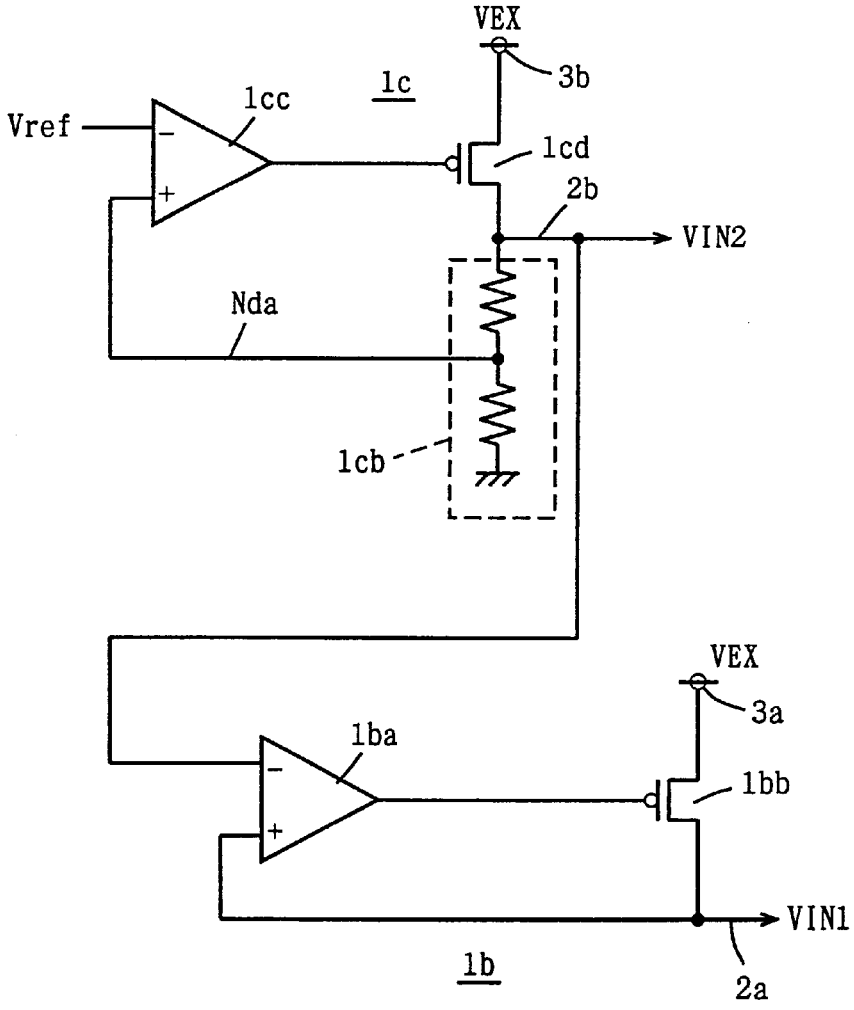
FIG. 10 illustrates the structure of a main part of a semiconductor integrated circuit device according to an embodiment 5 of the present invention.
Figure 11:
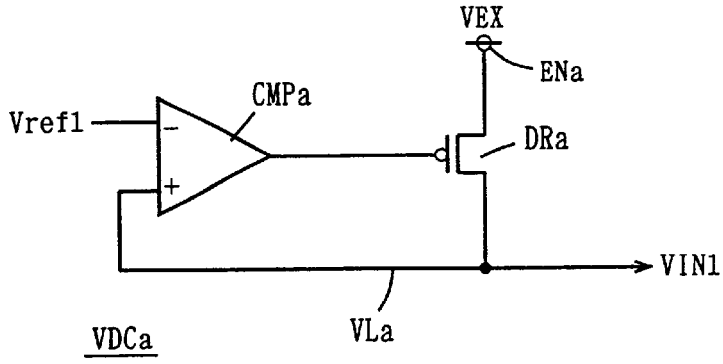
FIG. 11 PRIOR ART
FIG. 11 schematically illustrates the structure of a conventional direct feedback voltage down-converting circuit.
Figure 12:
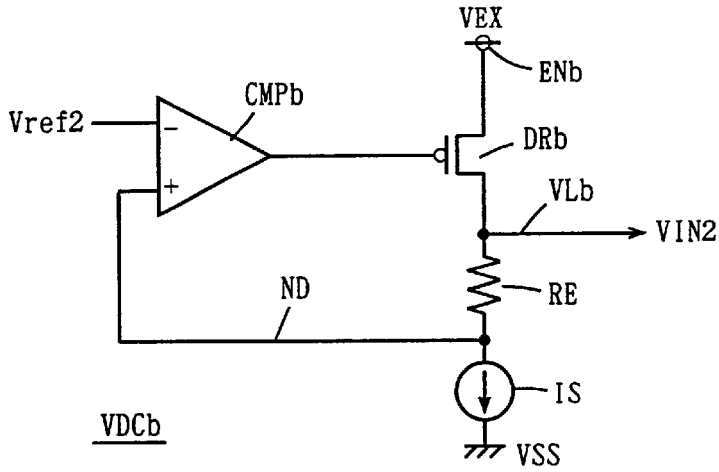
FIG. 12 PRIOR ART
FIG. 12 schematically illustrates the structure of a conventional voltage-dividing voltage down-converting circuit.
Figure 13:
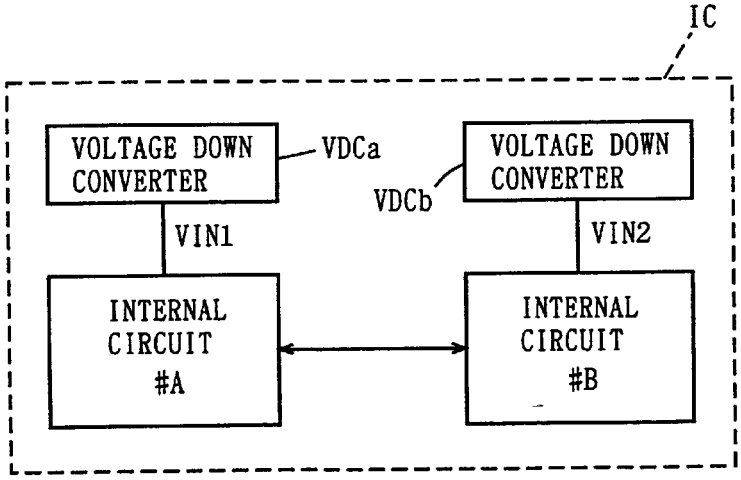
FIG. 13 PRIOR ART
FIG. 13 schematically illustrates the overall structure of a conventional semiconductor integrated circuit device.
Figure 14A:
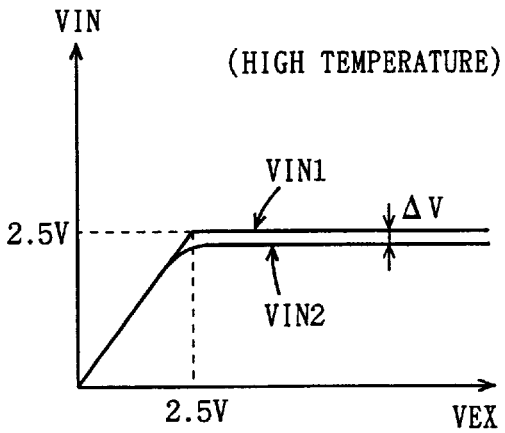
FIG. 14A PRIOR ART
FIGS. 14A and 14B schematically illustrate temperature dependency of internal power supply voltages.
Figure 14B:
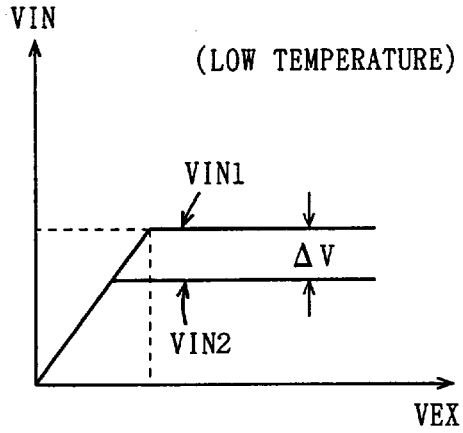
FIG. 14B PRIOR ART
Figure 15:
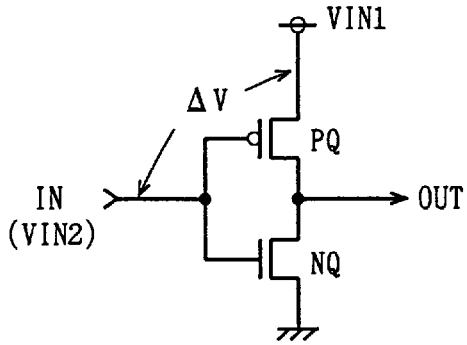
FIG. 15 PRIOR ART
FIG. 15 illustrates a problem of conventional internal power supply circuits.

FIG. 10 schematically illustrates the structure of a main part of a semiconductor integrated circuit device according to an embodiment 5 of the present invention. FIG. 10 shows the structures of a peripheral power supply circuit 1*c* and a sense amplifier power supply circuit 1*b*. Referring to FIG. 10, the peripheral power supply circuit 1*c* includes a voltage dividing circuit 1*cb* for dividing a power supply voltage VIN2 on an internal power supply line 2*b* by a prescribed voltage dividing ratio for transmission onto a node Nda, a comparator 1*cc* for comparing the voltage on the node Nda with a reference voltage Vref from a reference voltage generation circuit (not shown), and a current drive transistor 1*cd* connected between an external power supply node 3*b* and the internal power supply line 2*b* and supplying a current from the external power supply node 3*b* to the internal power supply line 2*b* in accordance with an output signal from the comparator 1*cc*.

The reference voltage Vref is generated by a well-known reference voltage generation circuit. The voltage VIN2 on the internal power supply line 2*b* is supplied to peripheral circuits (a memory cell selection circuit and a read/write circuit). A voltage-dividing voltage down-converting circuit employing the voltage dividing circuit 1*cb* has a high response speed, and the internal power supply voltage VIN2 is held at a substantially constant voltage level (the level of the reference voltage Vref) with very small fluctuation.

The sense amplifier power supply circuit 1*b* includes a comparator 1*ba* for comparing the voltage on an internal power supply line 2*a* with the internal power supply voltage VIN2, and a current drive transistor 1*bb* connected between an external power supply node 3*a* and the internal power supply line 2*a* and supplying a current from the external power supply node 3*a* to the internal power supply line 2*a* in accordance with an output signal from the comparator 1*ba*.

The sense amplifier power supply circuit 1*b* utilizes the internal power supply voltage VIN2 generated by the voltage-dividing voltage down-converting circuit as a reference voltage. In this case, an internal power supply voltage VIN1 substantially matches with the internal power supply voltage VIN2 due to a feedback loop of the comparator 1*ba*, the current drive transistor 1*bb* and the internal power supply line 2*a*. Therefore, difference in temperature characteristics between the internal power supply voltages VIN1 and VIN2 can be substantially eliminated.

A sense amplifier operates after a word line is selected and memory cell data is read on a bit line. In this state, only the sense amplifier operates in a row related circuit. No peripheral control circuit operates (excluding a bank structure or the like). Therefore, the internal power supply voltage VIN2 is held at a substantially constant stable level by the voltage-dividing voltage down-converting circuit of high-speed response, and the internal power supply voltage VIN1 is substantially held at a desired level in operation of the sense amplifier. The internal power supply voltages VIN1 and VIN2 can be stably held at the level of the reference voltage Vref.

A direct feedback voltage down-converting circuit required of high current suppliability generates the internal power supply voltage VIN1 from the sense amplifier power supply circuit 1*b*. If the level of the internal power supply voltage VIN1 is reduced, therefore, a relatively long time is required for recovering the same to a prescribed level. When the sense amplifier power supply voltage VIN1 is employed as the reference voltage for generating the internal power supply voltage VIN2 for the peripheral circuits, the level of the internal power supply voltage VIN2 for the peripheral circuits may so remarkably fluctuate to deviate from the constant level (noise of the sense amplifier power supply voltage VIN1 is transmitted to the peripheral circuit power supply voltage VIN2). When the peripheral circuit power supply voltage VIN2 is employed as the reference voltage for the sense amplifier power supply voltage VIN1, the internal power supply voltages VIN1 and VIN2 of a constant desired level can be stably supplied to the sense amplifier and the peripheral circuits.

According to the embodiment 5 of the present invention, as hereinabove described, the internal power supply voltage generated by the voltage-dividing voltage down-converting circuit is employed as the reference voltage for the direct feedback voltage down-converting circuit, whereby difference in temperature characteristics between the internal power supply voltages generated by the voltage down-converting circuits can be substantially eliminated and the circuits can be stably driven.

[Other Applications]

Each of the aforementioned embodiments uses a semiconductor memory device as the semiconductor integrated circuit device. However, the present invention is applicable to any device employing a direct feedback voltage down-converting circuit and a voltage-dividing voltage down-converting circuit.

In each of the embodiments 1 to 5, the internal power supply voltages VIN1 and VIN2 are at the same level of 2.5 V, for example. However, the levels of the internal power supply voltages VIN1 and VIN2 may differ from each other. This can be implemented by shifting the level of the reference voltage Vref1 with diode-connected p-channel and n-channel MOS transistors for supplying to the resistance dividing circuit in each of the embodiments 1 to 4, for example. The temperature dependency characteristics of the diode-connected p-channel and n-channel MOS transistors are in opposite directions, and can be cancelled out. Therefore, the level-shifted reference voltage and the internal power supply voltage generated by the voltage-dividing voltage down-converting circuit are identical in temperature dependency to each other, and hence the reference voltage before the level shifting and the internal power supply voltage generated by the voltage-dividing voltage down-converting circuit can be equalized with each other, so that the internal power supply voltages for the voltage-dividing voltage down-converting circuit and the direct feedback voltage down-converting circuit can be equalized in temperature dependency with each other.

The aforementioned structure employing level shifting may be implemented with a level shift circuit having small temperature dependency. In case of the embodiment 5, the levels of the internal power supply voltages VIN1 and VIN2 may be rendered different from each other by shifting the level of the internal power supply voltage VIN2 with a level shift element for supplying to the sense amplifier power supply circuit.

According to the present invention, as hereinabove described, the reference voltage employed by the direct feedback voltage down-converting circuit is divided by the same ratio as the voltage dividing ratio of the voltage dividing circuit of the voltage-dividing voltage down-converting circuit and employed as the reference voltage for the voltage-dividing voltage down-converting circuit, whereby the internal power supply voltages generated by the voltage-dividing voltage down-converting circuit and the direct feedback voltage down-converting circuit can be equalized in temperature dependency with each other and the circuit operation is stabilized with the internal power supply voltages having extremely small difference in temperature dependency.

Further, the internal power supply voltages can completely match in temperature dependency with each other by employing the internal power supply voltage generated by the voltage-dividing voltage down-converting circuit as the reference voltage for the direct feedback voltage down-converting circuit, leading to prevention of deterioration of circuit characteristics resulting from difference in temperature characteristics. Thus, a stably operating semiconductor integrated circuit device is provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor integrated circuit device comprising:

a first comparator for comparing a first reference voltage with a voltage on a first internal power supply line and outputting a signal indicating a result of the comparison;

a first current drive element coupled between a first power supply node for receiving an external power supply voltage and said first internal power supply line for supplying a current from said first power supply node to said internal power supply line in accordance with said signal outputted from said first comparator;

a first voltage dividing circuit for dividing a voltage on a second internal power supply line by a prescribed ratio for outputting;

a second voltage dividing circuit for dividing said first reference voltage by said prescribed ratio and generating a second reference voltage;

a second comparator for comparing said second reference voltage with said voltage outputted from said first voltage dividing circuit and outputting a signal indicating a result of the comparison; and a second current drive element connected between a second power supply node for receiving said external power supply voltage and said second internal power supply line for supplying a current from said second power supply node to said second internal power supply line in accordance with said signal outputted from said second comparator.

2. The semiconductor integrated circuit device in accordance with claim 1, wherein said first voltage dividing circuit includes means for activating the voltage-dividing operation thereof in accordance with a mode specifying signal for specifying an activation of an operation of at least a circuit consuming said voltage on said second internal power supply line.

3. The semiconductor integrated circuit device in accordance with claim 1, wherein said second comparator includes means for activating a comparison operation thereof in response to a mode specifying signal indicating an activation of a circuit consuming said voltage on said second internal power supply line.

4. The semiconductor integrated circuit device in accordance with claim 1, wherein said first voltage dividing circuit includes a first resistive element connected between said second internal power supply line and a first output node for outputting the divided voltage and a second resistive element connected between said first output node and a node supplying a prescribed base voltage, the ratio of the resistance values of said first and second resistive elements is a:b, and said prescribed ratio is given by b/(a+b), where a and b represent positive real numbers, and said second voltage dividing circuit comprises m third resistive elements serially connected between a node for receiving said first reference voltage and a second output node for outputting said second reference voltage, and m fourth resistive elements provided between said second output node and said node supplying the base voltage in correspondence to the third resistive elements respectively and serially connected with each other, the resistance ratios of corresponding ones of said m third resistive elements and said m fourth resistive elements each are said a:b, and said m represents a positive integer.

5. The semiconductor integrated circuit device in accordance with claim 4, wherein said second voltage dividing circuit further comprises program elements connected in parallel with (m−1) third and (m−1) fourth resistive elements among the m third and m fourth resistive elements for short-circuiting corresponding ones of the third and fourth resistive elements.

6. The semiconductor integrated circuit device in accordance with claim 5, wherein said program elements each comprises a fusible link element.

7. The semiconductor integrated circuit device in accordance with claim 5, wherein said program elements each comprises a switching transistor conducting in accordance with a test signal selectively activated in a test operation.

8. The semiconductor integrated circuit in accordance with claim 1, wherein said second voltage dividing circuit is connected between a first internal node and a second internal node receiving a base voltage, and receives a constant current from a constant current source at said first internal node to generate said first reference voltage at said first internal node.

9. A semiconductor integrated circuit device comprising:

an internal power supply circuit for generating a first internal power supply voltage being lower than an external power supply voltage on a first internal power supply line from said external power supply voltage;

a comparator for comparing a voltage on a second internal power supply line with said first internal power supply voltage and outputting a signal indicating a result of the comparison;

a current drive element connected between a power supply node receiving said external power supply voltage and said second internal power supply line for supplying a current from said power supply node onto said second internal power supply line in accordance with said signal outputted from said comparator;

a first internal circuit coupled to receive the first internal power supply voltage as an operating power supply voltage thereof, for performing a predetermined operation; and a second internal circuit coupled to receive the voltage on the second internal power supply line as an operating power supply voltage thereof, for performing another predetermined operation.

10. The semiconductor integrated circuit device in accordance with claim 9, wherein said internal power supply circuit comprises;

a level converter coupled to said first internal power supply line, for reducing a voltage level of said first internal power supply voltage for outputting, a comparison circuit for comparing the voltage supplied from said level converter with a reference voltage to generate a signal indicating a result of the comparison, and a current drive transistor responsive to the signal from said comparison circuit for supplying a current onto said first internal power supply line from a node receiving said external power supply voltage.

* * * * *